US005974625A

United States Patent [19]

Garner

[11] Patent Number: 5,974,625

[45] Date of Patent: Nov. 2, 1999

[54] LIFT OFF MECHANISM FOR A VACUUM CLEANER

[75] Inventor: David P. Garner, Niagara Fall, Canada

[73] Assignee: Fantom Technologies Inc., Welland, Canada

[21] Appl. No.: 08/685,584

[22] Filed: Jul. 24, 1996

[30] Foreign Application Priority Data

Jul. 23, 1996 [CA] Canada ..... 2181876

[51] Int. Cl.[6] ..... A47L 5/34

[52] U.S. Cl. ..... 15/354; 15/333; 15/361

[58] Field of Search ..... 15/354, 361, 333

[56] References Cited

U.S. PATENT DOCUMENTS 3,579,699 5/1971 Balzer ..... 15/361
4,446,594 5/1984 Watanabe et al. .
4,782,552 11/1988 Bartlett et al. .
5,222,276 6/1993 Glenn, III .
5,255,411 10/1993 Mendes da Costa .
5,269,042 12/1993 Stephens et al. .
5,467,502 11/1995 Johnson et al. ..... 15/354 X
5,551,120 9/1996 Cipolla et al. ..... 15/361 X

*Primary Examiner*—Chris K. Moore
*Attorney, Agent, or Firm*—Philip C. Mendes da Costa Bereskin & Parr

[57] ABSTRACT

A height adjustment mechanism for a vacuum cleaner includes forwardly positioned lift off wheels which move downwardly when the handle of the vacuum cleaner is moved to the raised position. Two transfer members convert the rotational movement of the handle to vertical motion of the lift off wheels.

24 Claims, 7 Drawing Sheets

LIFT OFF MECHANISM FOR A VACUUM CLEANER

FIELD OF THE INVENTION

The present invention relates to a means for automatically lowering the surface cleaning nozzle of an upright vacuum cleaner when the handle is moved from an upright storage position to a lower operating position and automatically raising the surface cleaning nozzle when the handle is returned to the upright storage position.

BACKGROUND TO THE INVENTION

Upright vacuum cleaners typically comprise a ground engaging portion having a surface cleaning nozzle and a handle portion which contains dust separation and storage means. Upright vacuum cleaners typically have a rotating brush which is positioned above the surface cleaning nozzle. The bristles of the rotating brush extend downwardly so as to contact the surface to be cleaned, such as a carpet.

The handle of an upright vacuum cleaner is typically operable between an upright storage position and a lower operating position. Numerous upright vacuum cleaners include or are adapted to receive extension hoses so that the upright vacuum cleaner may also be operated to clean surfaces located above the floor (the above the floor vacuum mode). When an upright vacuum cleaner is operated in the above the floor mode, the handle is typically locked in the upright storage position. Accordingly, in order to avoid damage and excessive wear to the carpet when the vacuum cleaner is used in the above the floor mode, the vacuum cleaner may include either brush disengagement means for disengaging the rotating brush from its motor drive means, or a lift off mechanism to raise the surface cleaning nozzle to a position above the carpet.

A problem which many lift-off mechanisms for upright vacuum cleaners is that they utilize a plurality of relatively small parts. Despite their size, these parts are subject to large forces when the lift-off mechanism is utilized. As such, these parts are susceptible to wear and breakage.

Typically, lift-off mechanisms are activated by movement of the handle between an upright storage position and a lower operating position. Thus the handle provides a long moment arm to operate the lift-off mechanism. Despite the use of the long moment arm, the user may still have to apply considerable force to move the handle to the upright storage position so as to operate the lift-off mechanism.

SUMMARY OF THE INVENTION

In accordance with this invention, there is provided an upright vacuum cleaner for cleaning a surface, the upright vacuum cleaner comprising:

(a) a longitudinally extending ground engaging portion having a surface cleaning nozzle, rear wheels and lift off wheels, the lift off wheels positioned forwardly of the rear wheels and moveable between a raised operating position and a lowered storage position;

(b) a handle pivotally mounted on the ground engaging portion, the handle moveable between a raised storage position and a lowered operating position, the handle having a lower portion;

(c) first transfer member having first and second engagement surfaces, each of the surfaces moveable between a first position in which the lift off wheels are in a lowered operating position and a second position in which the lift off wheels are in the raised storage position;

(d) first engagement member for engaging the first engagement surface, the first engagement member drivenly connected to the lower portion of the handle for movement of the first engagement surface between the first and second positions as the handle moves from the operating position to the storage position; and, (e) second transfer member for engaging the second engagement surface, the second transfer member being operably connected to the lift off wheels for movement of the lift off wheels between the raised and lowered positions as the handle moves from the operating position to the storage position;

whereby, as the handle is pivoted from the operating position to the storage position, the first engagement member engages the first engagement surface and moves the first engagement surface to the second position causing the second engagement surface to move the second transfer member to the second position, thereby moving the lift off wheels from the raised position to the lowered position and consequently raising the surface cleaning nozzle to a raised position.

The lift off mechanism of the present invention provides a simplified method of raising the surface cleaning nozzle above the surface to be cleaned automatically as the handle of the upright vacuum cleaner is pivoted from a lowered operating position to the raised storage position.

Further, the lift off mechanism provided in the present invention may be used in conjunction with a height adjustment mechanism which, when the handle is pivoted from the upright (raised) storage position to a lowered operating position, automatically lowers the surface cleaning nozzle to a predetermined position above the surface to be cleaned.

BRIEF DESCRIPTION OF THE DRAWINGS

These and other advantages of the instant invention will be more fully and completely understood through a consideration of the following description taken together with the drawings of a preferred embodiment of the invention in which.

DETAILED DESCRIPTION OF THE PREFERRED EMBODIMENT

Figure 1:
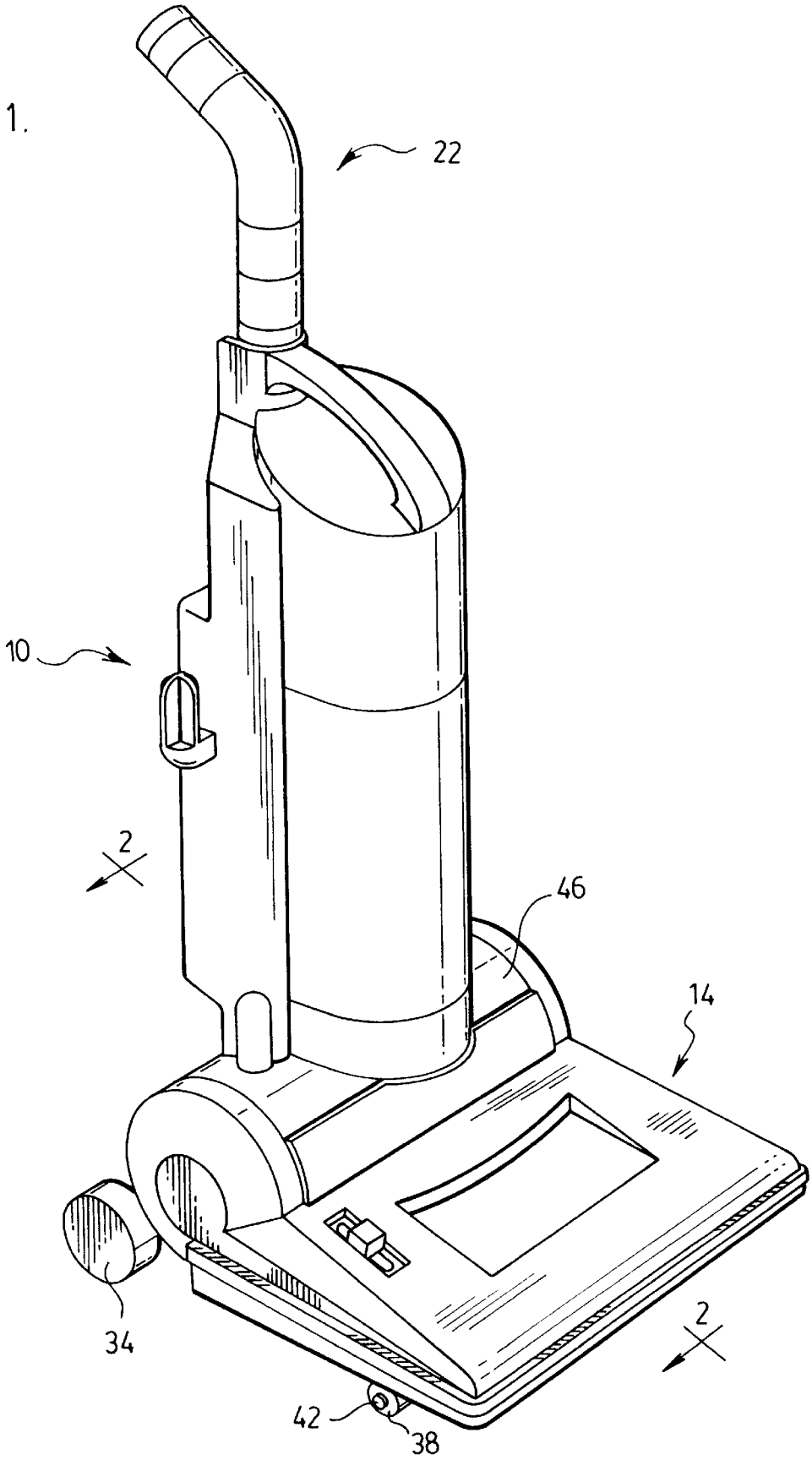
FIG. 1 is a perspective view of a preferred embodiment of a vacuum cleaner made in accordance with the present invention.

Referring to FIG. 1, there is shown an upright vacuum cleaner in accordance with the present invention, generally indicated by reference numeral 10. Vacuum cleaner 10 has ground engaging portion 14 and handle 22.

Figure 2:
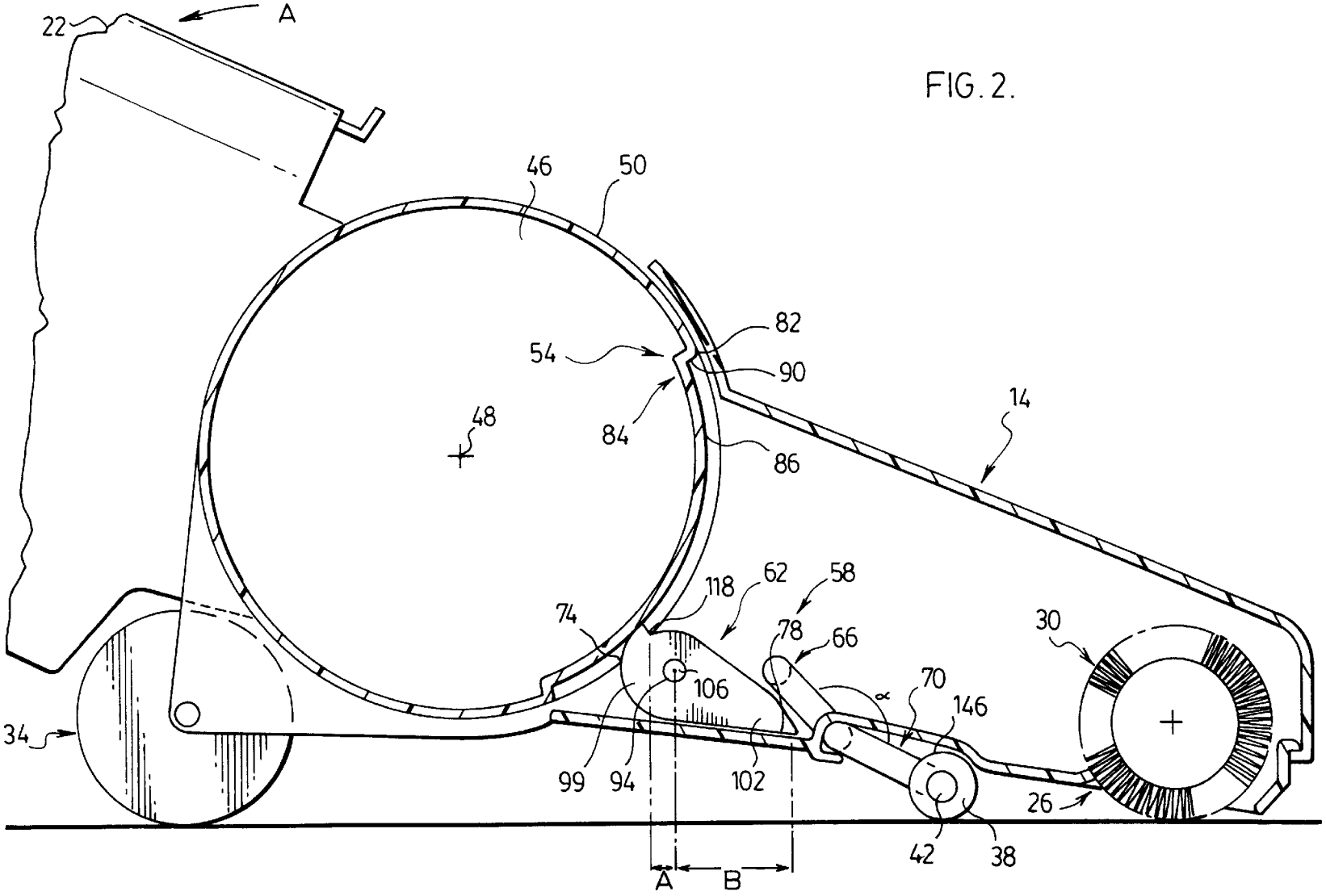
FIG. 2 is a cross-sectional view taken along line 2—2 of the vacuum cleaner of FIG. 1, without height adjustment means shown, wherein the surface cleaning nozzle is in the lowered position.

Referring now to FIG. 2, ground engaging portion 14 may be of any design known in the art of upright vacuum cleaners. Preferably, ground engaging portion 14 has surface cleaning nozzle 26 and rotating brush 30. Surface cleaning nozzle 26 is located on the bottom of and preferably at the front end of ground engaging portion 14. Rotating brush 30 is rotatably mounted within ground engaging portion 14 at a position above surface cleaning nozzle 26. Rotating brush 30 may be rotatably driven by means of a drive belt or other means known in the art (not shown).

Ground engaging portion 14 is provided with rear wheels 34, which are rotatably mounted at the rear end of ground engaging portion 14. Lift off wheels 38 are also mounted on ground engaging portion 14, forward of rear wheels 34, and preferably at an intermediate position between handle 22 and surface cleaning nozzle 26. More preferably, lift off wheels 38 are rotatably mounted on axle 42 which is mounted on ground engaging portion 14, and are located immediately behind surface cleaning nozzle 26. Rear wheels 34 and lift off wheels 38 allow the operator of the vacuum cleaner to move the vacuum cleaner over the surface to be cleaned.

Housing 46 comprises the lower end of handle 22. Handle 22 may include a mechanism for separating dust and entrained dirt from the air, and a storage compartment for dust and separated entrained dirt (not shown).

Figure 3:
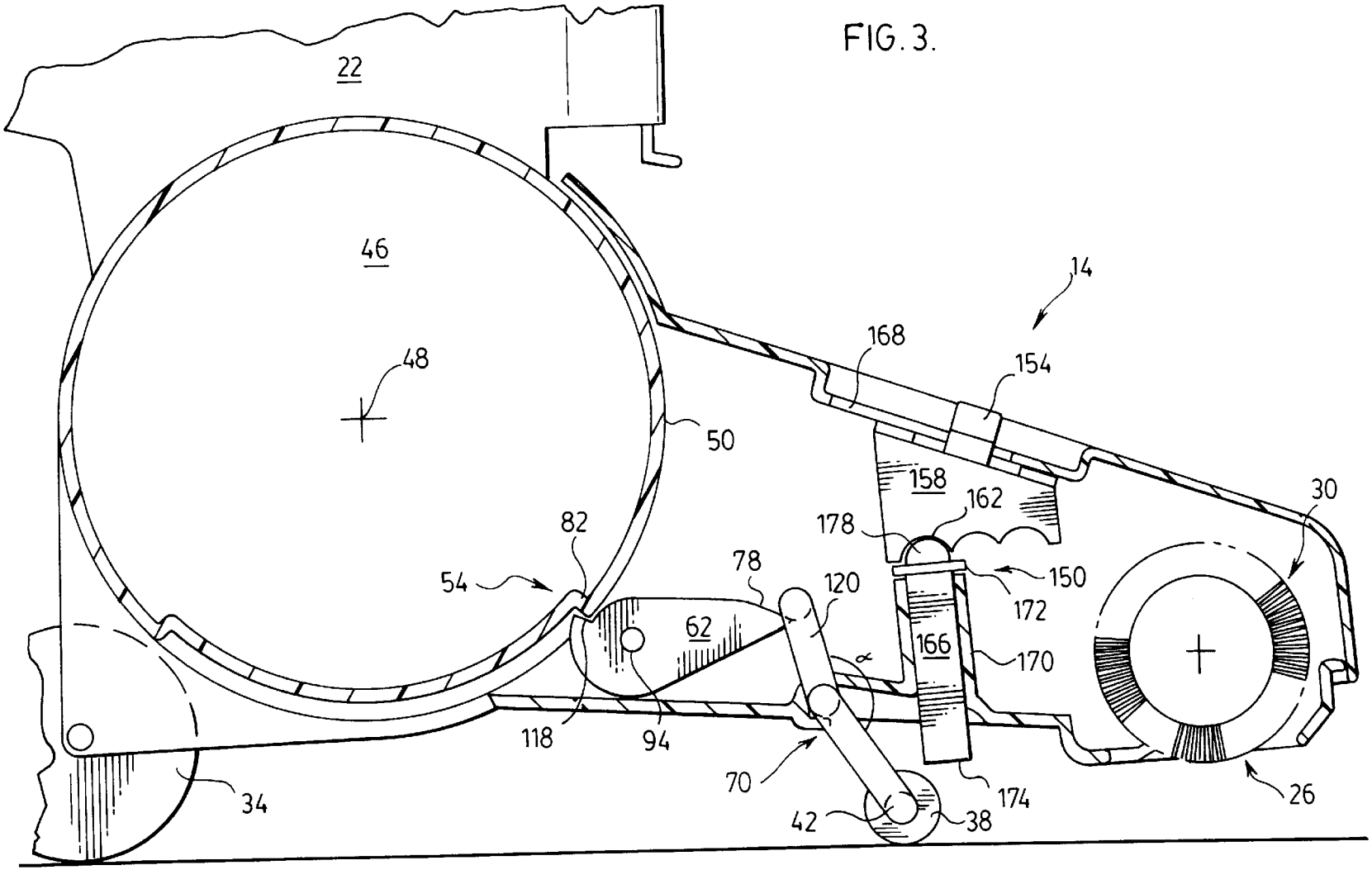
FIG. 3 is a similar cross-sectional view to FIG. 2, wherein the surface cleaning nozzle is in a raised position.

Handle 22 is pivotally mounted on ground engaging portion 14 by pivotally mounting housing 46 with respect to ground engaging portion 14 by any means known in the art. Thus handle 22 may be pivoted about pivot axis 48 between an upper (raised) storage position, as shown in FIGS. 1 and 3, and a plurality of lowered operating positions, one of which is shown in FIG. 2. Preferably, when housing 46 is in the upper storage position, handle 22 is in a substantially upright position. As handle 22 and consequently housing 46 is pivoted from the upper storage position to a lowered operating position, handle 22 and housing 46 rotate in the direction of arrow A as shown in FIG. 2. Preferably, housing 46 and handle 22 may be locked in the upper storage position by any means known in the art. Preferably, release means such as a foot operated pedal (not shown) is provided to permit handle 22 to be easily released from its storage position and pivoted into an operating position.

Housing 46 is preferably of a size and shape to accommodate the motor for the vacuum cleaner. More preferably, housing 46 has a cylindrical peripheral surface 50 with the axis of cylindrical peripheral surface 50 being coaxial with pivot axis 48. In such an arrangement, housing 46 may have a suction inlet port which is connected to surface cleaning nozzle 26 by a suction passageway. Also, housing 46 may have a suction outlet port which is connected to the filtration and storage mechanism in the handle by an additional suction passageway (not shown). Such arrangements are known in the art.

Lift off means 58 is provided for raising and lowering surface cleaning nozzle 26 over the surface to be cleaned. Lift off means 58 comprises a first engagement member (first can engagement means, 54), a first transfer member (cam member 62), a second transfer member having an engagement portion to engage the first transfer member (second cam engagement means 66), and a connecting portion connected to the lift-off wheels (connecting means 70). Cam member 62 has abutment surface 118 and cam surface 78.

Figure 4:
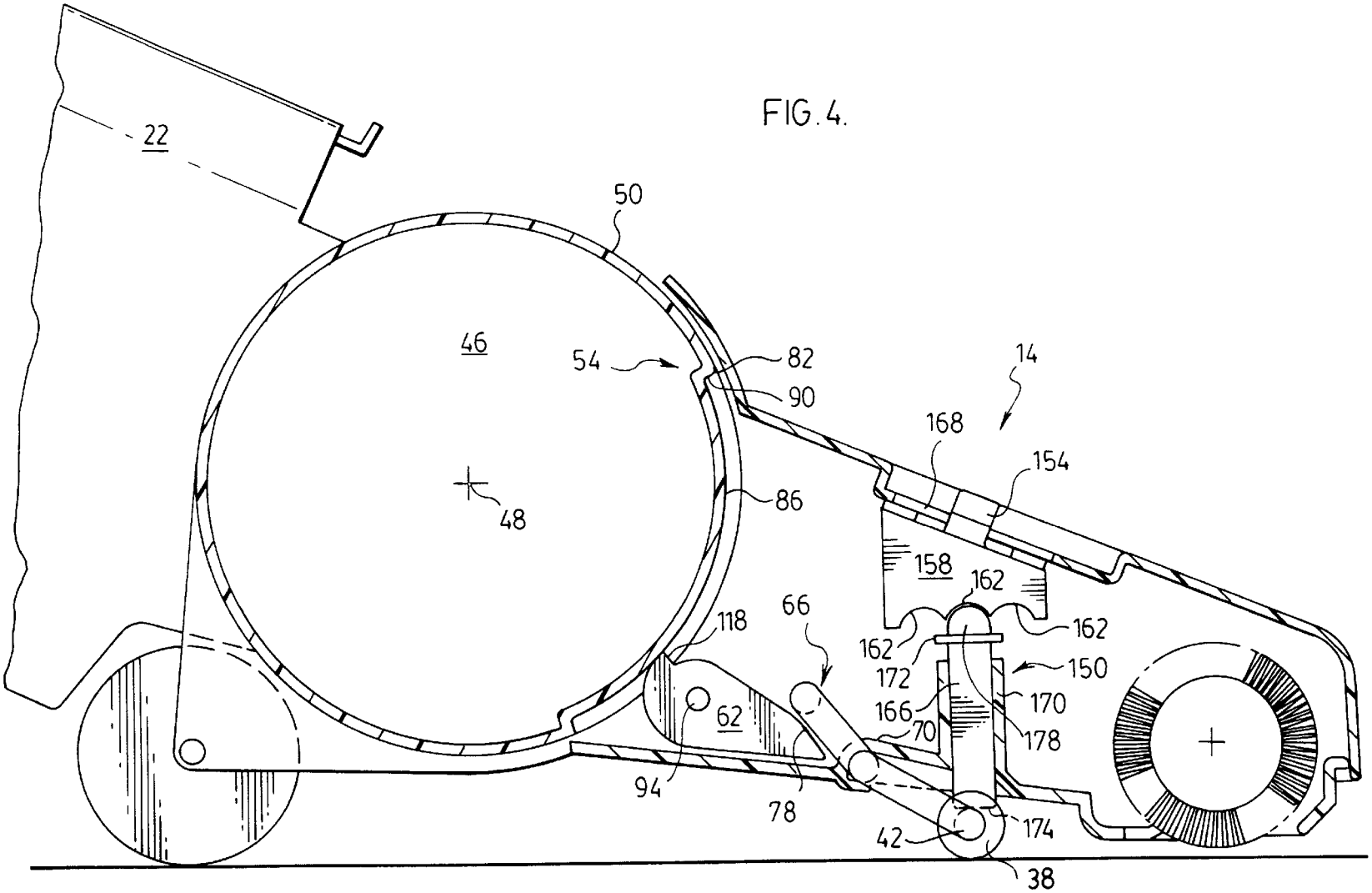
FIG. 4 is a cross-sectional view taken along line 2—2 of the vacuum cleaner of FIG. 1, with height adjustment means shown, wherein the surface cleaning nozzle is in a raised position.

First cam engagement means 54 is a first engagement member which is positioned and adapted to engage a first portion of the first transfer member (abutment surface 118 ) of cam member 62) as housing 46 is rotated to the upright storage position. First cam engagement means 54 may be any means for contacting abutment surface 118 and moving cam member 62. Preferably first cam engagement means 54 comprises an indentation 82 located on peripheral surface 50. More preferably, indentation 82 is integrally formed with peripheral surface 50. As shown in FIGS. 2, 3 and 4, indentation 82 is preferably located on the forward portion of peripheral surface 50.

Indentation 82 may be defined by one end 84 of a groove 86 located in peripheral surface 50. Indentation 82 has an abutment surface 90 defined by the depth of groove 86 into peripheral surface 50. Surface 90 may be of any profile that will engage abutment surface 118 and is preferably flat, and may extend radially outwardly from the surface of groove 86 to peripheral surface 50. The circumferential length of groove 86 is preferably such that handle 22 of the vacuum cleaner may be rotated to its lowermost operating position without peripheral surface 50 coming into contact with cam member 62. Groove 86 may have a width in the axial direction larger than the width of cam member 62 so that the side portions of cam member 62 which lies within groove need not come into contact with peripheral surface 50 as handle 22 is rotated.

Figure 5:
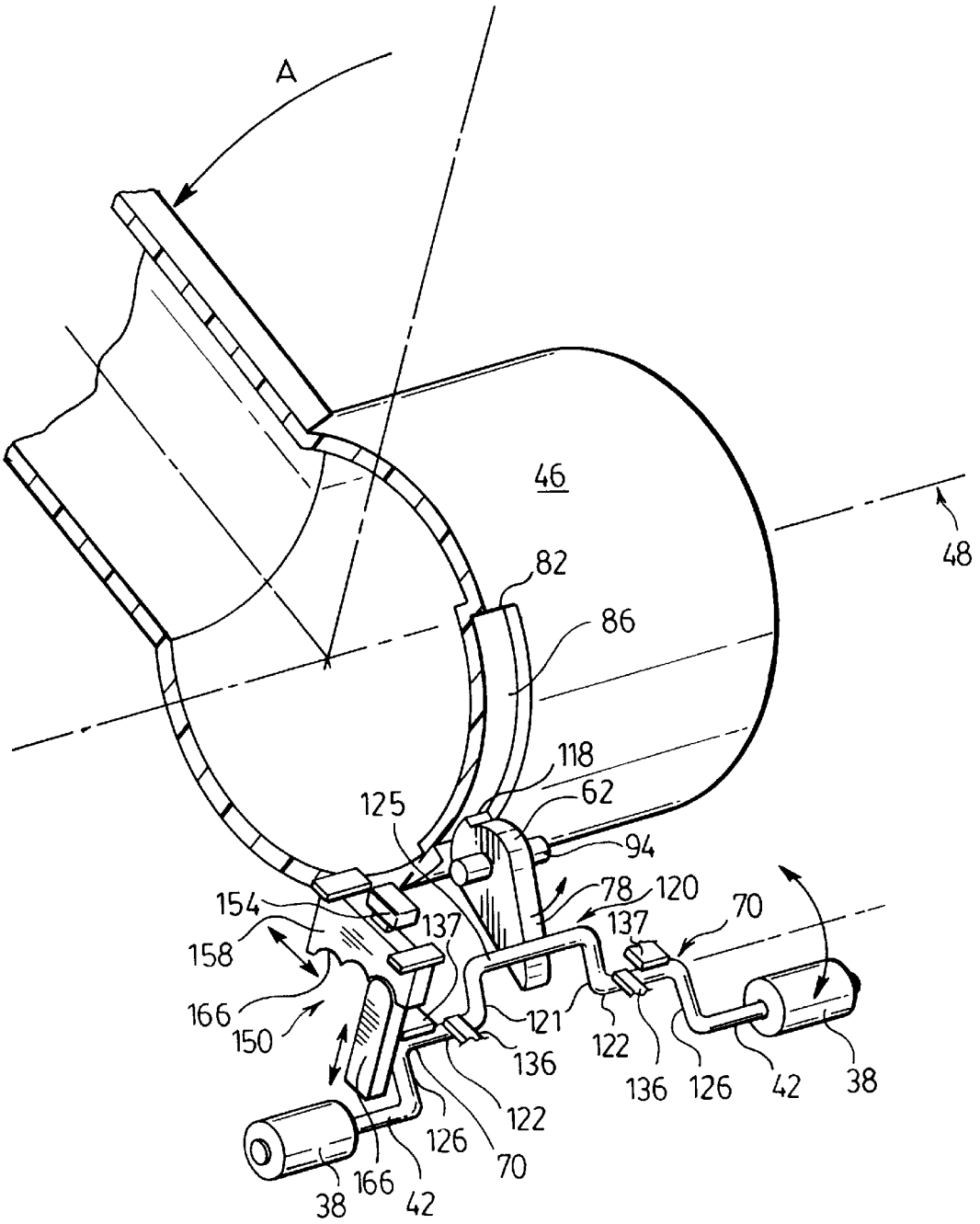
FIG. 5 is a perspective view of the lift off mechanism used in accordance with the present invention.
Figure 6:
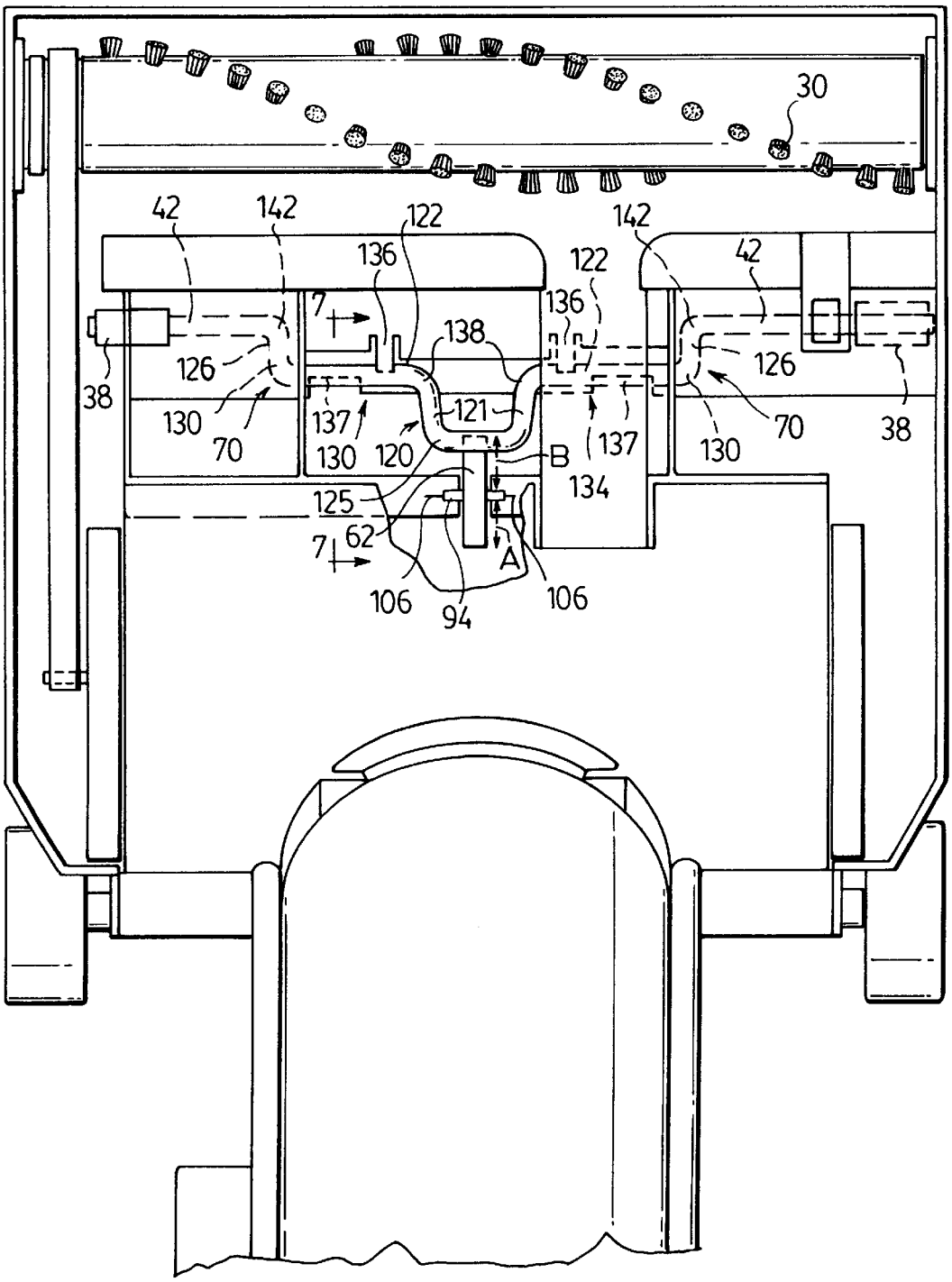
FIG. 6 is a top plan view of the ground engaging portion of the vacuum cleaner with its cover partially removed.

Second cam engagement means 66 may be of any design adapted to engage cam surface 78 and lower axle 42 through the movement of cam member 62. Connecting means 70 links second cam engagement means 66 to axle means 40 so that movement of second cam engagement means 66 induced by cam surface 78 causes an opposite movement of axle means 42. Preferably, as shown in the drawings, connecting means 70 may be pivotally mounted to redirect upward movement of cam surface 78 to downward movement of axle means 42. Second cam engagement means 66 may comprise a generally U-shaped member 120 (as best seen in FIGS. 5 and 6). U-shaped member 120 is pivotally mounted on ground engaging portion 14 at a position forward of cam surface 78. Upward movement of U-shaped member 120 causes downward movement of wheels 38.

As shown in FIGS. 5 and 6, connecting means 70 may comprise a kinked axle which is integrally formed with axle 42 and U-shaped member 120. According to this design, connecting means 70 comprises a first, transversely extending connecting member 122 and a second connecting member 126. Connecting member 126 extends forwardly from transversely extending connecting member 122 and is preferably positioned in an opposed manner to side members 121. First connecting member 122 and second connecting member 126 preferably meet at curved potion 130 and define approximately a 90° angle. First connecting member 122 and side members 121 meet at curved portion 138 and preferably define a 90° angle. Second connecting member 126 and axle 42 meet at curved portion 142 and preferably define a 90° angle. It will be appreciated that connecting means 70 need not be a single, integrally formed unit. Instead, for example, a plurality of individual arm members may be utilized.

In this preferred embodiment, the longitudinal axis of axle 42 is parallel with the longitudinal axis of first connecting member 122. Further, U-shaped member 120 extends rearwardly and upwardly from transverse connecting member 122 while second connecting member 126 extends forwardly and downwardly from connecting member 122. When viewed in the horizontal plane, U-shaped member 120 and second connecting member 126 form an angle $\alpha$(as seen in FIGS. 2 and 3). Angle $\alpha$ is preferably between about 90° and about 180°. Angle $\alpha$ is selected so that the desired amount of lift is effected at wheels 38, while maintaining U-shaped member 120 on cam surface 78, and abutment surface 118 on surface 90. Additionally, angle α is selected such that there may be a clearance between U-shaped member 120 and cam surface 78 when the handle of the vacuum cleaner is in a lowered operating position. If the angle α is too large, U-shaped member 120 will rest on cam surface 78 when the handle is in a lowered operation position, possible preventing wheel 38 from retracting towards or into ground engaging position 14 (i.e. the wheels 38 will not be raised sufficiently from the surface being cleaned to permit efficient cleaning). Alternately, if the angle α is too small, the U-shaped member 120 will be spaced too far from cam surface 78 when the handle is in the operating position. In this case, when the user moves the handle from the operating position to the storage position, some rotary motion is lost in first moving cam surface 78 into contact with the U-shaped member 120. This loss of rotation is translated through the connecting means 70, and results in a loss of lift of lift off wheels 38. This may result in a less than desired clearance between rotating brush 30 and the surface being cleaned.

Additionally, it will be appreciated that the relative lengths of side members 121 and 126 are important for the same reasons. By altering this ratio or equally altering the length of side members 121 and 126 the distance travelled by lift off wheels 38 for a defined movement of cam surface 78 may be increased or decreased.

Connecting member 122 is pivotally mounted on ground engaging portion 14 by means of pivot mounts 134. Pivot mounts 134 may be of any design known in the art which allow connecting means 70 to pivot with respect to ground engaging portion 14. Preferably, pivot mounts 134 may comprise standard pivot clips. As best seen in FIG. 6, pivot mounts 134 may comprise tabs 136 and 137 located on either side of connecting member 122. Tabs 136 and 137 may be integrally formed with the housing of ground engaging portion 14. In this manner, connecting member 122 is held in place in ground engaging portion 14 by friction between tabs 136 and 137, and is allowed to pivot therein. Preferably, tabs 136 and 137 are provided for each connecting member 122 as shown.

Figure 7:
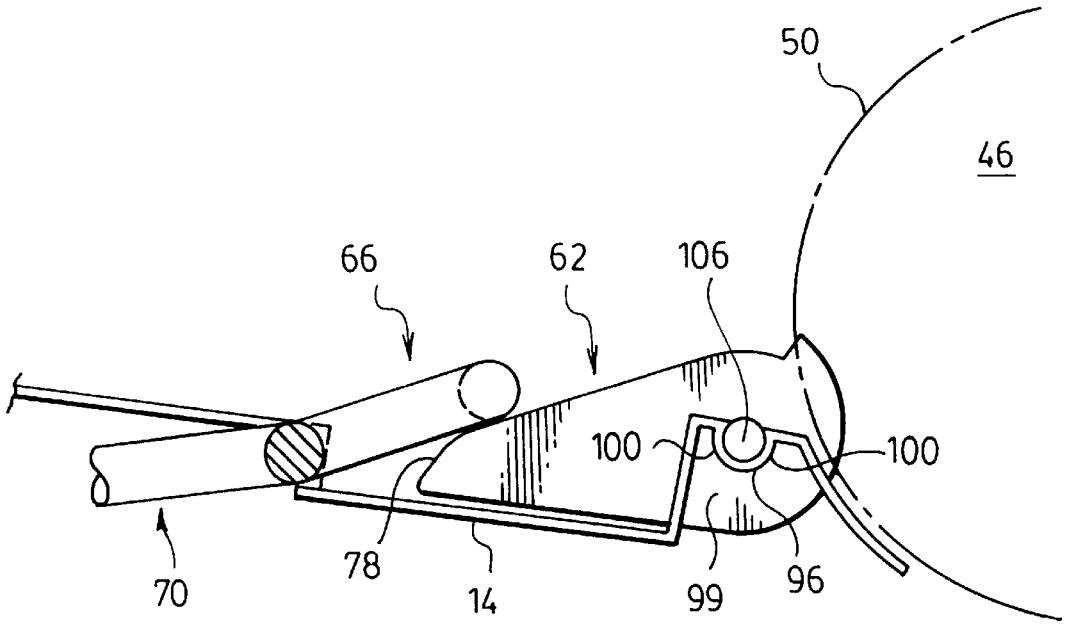
FIG. 7 is a cross-sectional view taken along the line 7—7 in FIG. 6.

Cam member 62 is provided to drivingly connect handle 22 with lift off wheels 38 thus using the final rotational movement of handle 22 as it is moved from or into the storage position to raise and lower lift off wheels 38. Cam member 62 is pivotally mounted to ground engaging portion 14 by pivot means, such as pivot pin 94. Pivot pin 94 defines pivot axis 106 (see FIG. 6). Referring to FIG. 7, pivot pin 94 may be lockingly received for pivotal rotation in arcuate slots 96 located in pivot mounts 98. Pivot mounts 98 may be integrally formed with the casing of ground engaging portion 14. In order to secure pivot pin 94 in slot 96, preferably the upper portion of sides 100 of slot 96 are spaced apart a distance less than the diameter of pivot pin 94. By this manner, pivot pin 94 is secured in place and is allowed to rotate within slot 96.

As shown in FIGS. 2–4, cam member 62 is a longitudinally extending member having a generally tear drop shaped profile. The shape of cam member 62 is generally defined by abutment surface 118 and cam surface 78. The rearward end of cam member 62 is preferably arcuate in shape and is referred to herein as arcuate end 99. Cam member 62 has means which are positioned and adapted to engage first cam engagement means 54. In the exemplified embodiment, this engagement means comprises abutment surface 118 which is provided on arcuate end 99 of cam member 62. Abutment surface 118 is sized and shaped, and is positioned, to engage indentation 82 and to cause cam member 62 to pivot in response to movement of housing 46. Cam member 62 is preferably located within ground engaging portion 14 such that first cam engagement means 54 engages surface 118 when handle 22, and thus housing 46, are pivoted from the lower operating position to the upper storage position. As shown, abutment surface 118 may be provided as a cut out portion on the upper portion of arcuate end 99.

Surface 74 is located on the rearward surface of arcuate end 99. Surface 74 may be of any particular shape provided that it does not impede the rotation of housing 46. Accordingly, surface 74 may be shaped so that, as cam member 62 pivots, surface 74 does not contact peripheral surface 50 of housing 46. Alternately, surface 74 may be shaped so that, as cam member 62 pivots, part or all of surface 74 contacts peripheral surface 50 of housing 46. As shown herein, the curvature of surface 74 is preferably selected to match the curvature of the portion of housing 46 on which indentation 82 is positioned so that as cam member 62 pivots, surface 74 cams along peripheral surface 50 in groove 86.

This second portion of the first transfer member (forward end) of cam member 62 is generally shaped as a wedge and is referred to herein as wedge shaped end 102. Cam surface 78 is located on wedge shaped end 102. Cam surface 78 is sized and shaped, and is positioned, to engage U-shaped member 120 and to cause connecting means 70 to pivot in response to movement of cam member 62. As shown, cam surface 78 is slightly convex.

In the preferred embodiment shown in FIG. 2, surface 74 and cam surface 78 are longitudinally displaced from each other on either side of pivot axis 106. Further, it is preferred that pivot axis 106 is provided in the rearward portion of cam member 62. As shown in FIG. 5, first moment arm A is defined as extending between surface 118 and pivot pin 94, and second moment arm B is defined as extending between pivot pin 94 and the furthest point of contact between cam surface 78 and U-shaped member 120. Thus, pivot pin 94 is preferable located such that first moment arm A is smaller than second moment arm B. Preferably, the ratio of the length of moment arm A to moment arm B is such that the desired amount of clearance between rotating brush 30 and the surface being cleaned is achieved with a minimal amount of movement of abutment surface 118. By providing a small first moment arm A, and a larger second moment arm B, surface 118 only has to pivot downwardly a relatively short distance in order to cause U-shaped member 120 to travel along cam surface 78. Accordingly, only a short movement of handle 22 is necessary to raise and lower lift off wheels 38.

As will be appreciated, this design of lift off means 58 provides a simple, effective manner of raising surface cleaning nozzle 26 over the surface to be cleaned. As handle 22 is moved from its lower operating position to its upright storage position, first cam engagement means 54 rotates downwardly towards surface 118. As the upward movement of the handle continues, first cam engagement means 54 contacts surface 118 and forces rear arcuate end 99 to move downwardly. The downward movement of arcuate end 99 causes wedge shaped end 102 to pivot upwardly. As wedge shaped end moves upwardly, second cam engagement means 66 cams along cam surface 78 and causes second cam engagement means 66 to move upwardly. This upward movement is transmitted through connecting means 70 and causes axle 42 and consequently lift off wheels 38 to be lowered, thus raising surface cleaning nozzle 26.

It will be appreciated that by use of the single cam member 62 pivotally mounted to ground engaging portion 14, and having a first smaller moment arm A and a second larger moment arm B, surface 118 need only be moved a short distance in order to move cam surface 78 a longer distance. As a result, handle 22 need only be moved a short distance in order to move lift off wheels 38 a larger distance. Further, this provides a large arc through which handle 22 may be rotated without causing ground engaging portion 14 to be raised off the surface to be cleaned. In addition, as the moment arm of handle 22 is very long compared with the distance from peripheral surface 50 to lift off wheels 38, it takes a relatively smaller effort to move handle 22 the requisite amount to lower lift off wheels 38.

In order to allow surface cleaning nozzle 26 to be lowered to a position directly over the surface to be cleaned, recess 146 may be provided in the lower surface of ground engaging portion 14. Recess 146 is of a size and shape to accommodate lift off wheels 38 therein. As can be seen in FIG. 2, recess 146 may be somewhat arcuate in cross-section, so as to conform to the shape of lift off wheels 38. Alternatively, recess 146 could be any other design which allow lift off wheels 38 to recede into ground engaging position 14 sufficiently far so as to allow surface cleaning nozzle 26 to be lowered sufficiently to clean the carpet or other surface to be cleaned. For example, recess 146 could be an opening in the lower plate of ground engaging portion 14 (not shown). By providing recess 146, this allows lift off wheels 38 to move from a recessed position as shown in FIG. 3, in which the handle is in a lower operating position, to a lowered position as shown in FIG. 4, in which the handle is in the upright storage position.

Preferably, lift of means 58 and recess 146 are of such a design that when handle 22 is in the lower operating position, lift off wheels 38 extend downwardly a sufficient distance to maintain surface cleaning nozzle 26 a working distance above the surface to be cleaned and have sufficient clearance to freely rotate without contacting ground engaging portion 14. Further, when handle 22 is in the upright storage position, lift off wheels 38 are extended such that surface cleaning nozzle 26 has sufficient clearance from the surface to be cleaned so that a rotating brush positioned in surface cleaning nozzle 26 does not contact the surface on which the vacuum cleaner is positioned.

As best seen in FIGS. 3 and 4, the upright vacuum cleaner 10 may optionally be provided with height adjustment means 150 for adjusting the distance that lift off wheels 38 can be recessed into recess 146. This allows the user to predetermine the height at which surface cleaning nozzle 26 is positioned above the surface to be cleaned when the handle is in a lower operating position, for example to accommodate carpets having different piles.

Height adjustment means 150 may be any design known in the art. As exemplified in FIGS. 3, 4 and 5, height adjustment means 150 may comprise adjustment post 154 and bearing block 158 with bearing surfaces 162 which comprise the first detent member and post 166. As can be seen, in this embodiment, the upper portion of the casing of ground engaging portion 14 is at an angle relative to the surface to be cleaned. Adjustment post 154 is fixedly secured to bearing block 158, and may be made integrally therewith. Adjustment post 154 is an abutment member which may be slidably mounted in the upper portion of the casing of ground engaging portion 14, through slot 168. The lower surface of bearing block 158 has a plurality of bearing surfaces 162, and may generally lie in a plane parallel to the surface on which ground engaging portion 14 travels over. It will be appreciated that as adjustment post 154 (and consequently bearing block 158) is moved forwardly, the lower surface of bearing block 158 correspondingly moves downwardly, due to the angle of the casing of ground engaging portion 14. Conversely, as adjustment post 154 (and consequently bearing block 158) is moved rearwardly, the lower surface of bearing block 158 correspondingly moves upwardly.

Post 166 is a generally vertically extending member which extends generally vertically from bearing surfaces 162 towards axle 42. Post 166 is slidably mounted, such as in cylindrical bore 170. Cylindrical bore 170 may be integrally formed with the casing of ground engaging portion 14. Limiting means, such as collar 172 may be provided to limit the extent to which post 166 may extend downwardly through cylindrical bore 170. Post 166 has lower end 174 which is adapted to contact axle 42 and/or connecting means 70 to limit the distance that lift off wheel 38 may travel into recess 146. Preferably lower end 174 provides an abutment surface against which axle 42 may rest. Thus, when the user picks up the vacuum cleaner, lift off wheels 38 will descend under the force of gravity and as the vacuum cleaner is placed on a surface, lift off wheels will deflect upwardly until axle 42 contacts lower end 174. Preferably the ground engaging portion is configured e.g. by an abutment means, to limit the downward movement of lift off wheels 38 from descending under gravity so far that member 120 could accidentally become disengaged from cam surface 78, to a position underneath the cam 62 (which would render the lift off mechanism inoperative).

Post 166 has upper end 178 which comprise a second detent member and may be rounded in shape to correspond with the shape of bearing surfaces 162. As adjustment post 154 is moved forwardly and downwardly (together with bearing block 158), a different bearing surface comes into contact with post 166, and pushes post 166 further downwardly. Alternatively, if adjustment post 154 is moved rearwardly and upwardly, post 166 will recede further into ground engaging portion 14. Consequently, axle 42 correspondingly moves upwardly or downwardly which in turn lowers or raises surface cleaning nozzle 26 respectively. By providing a series of distinct bearing surfaces 162, post 166 (and consequently axle 42) may be raised or lowered a predetermined discrete amount. The amount which axle 42 is raised or lowered by each successive bearing surface 162 is determined by the angle of the upper surface of ground engaging portion 14 relative to the ground and the spacing of bearing surfaces 162. The steeper the angle, the larger the distance which axle 42 will be raised or lowered by each successive bearing surface 162. It will be appreciated that if the upper surface of the casing were horizontal instead of inclined, the bearing surface would be inclined to the horizontal.

Preferably, height adjustment means 150 has indicating means (not shown) for indicating the relative height of surface cleaning nozzle 26 above the surface to be cleaned. The indicating means maybe of any design known, for example markings located on the casing of ground engaging portion corresponding to the various locations at which different bearing surfaces 162 engage post 166.

It will be appreciated that various changes may be made within the spirit of the described invention, and all such changes are within the scope of the appended claims.

I claim:

1. An upright vacuum cleaner for cleaning a surface, comprising:

(a) a longitudinally extending ground engaging portion having a surface cleaning nozzle, rear wheels and lift off wheels, said rear wheels positioned adjacent the rear of said ground engaging portion, said lift off wheels positioned forwardly of said rear wheels, said lift off wheel being rotatably mounted on a transversely extending axle means and moveable between a raised position and a lowered position;

(b) a handle pivotally mounted on said ground engaging portion, said handle moveable between a raised storage position and a lowered operating position, said handle having a lower portion;

(c) a cam member pivotally mounted about a first pivot axis and having a first portion and a second portion, said first and second portions positioned on opposite sides of said first pivot axis, each of said portions being moveable between a first position in which said lift off wheels are in said raised operating position and a second position in which said lift off wheels are in said lowered storage position as said cam member pivots about said first pivot axis;

(d) first cam engagement means for engaging said first portion, said first cam engagement means drivenly engaged by said lower portion of said handle for movement of said first portion between said first and second positions as said handle moves from said operating position to said storage position;

(e) second cam engagement means engageable by said second portion for movement of said second cam engagement means as said second portion moves between said first and second positions as said handle moves from said operating position to said storage position; and, (f) connecting means pivotally mounted about a second pivot axis on said ground engaging member and operably connected to said second cam engagement means and said axle means, whereby, as said handle is pivoted from said operating position to said storage position, said first cam engagement means engages said first portion and moves said first portion to said second position causing said second portion to move said second cam engagement means to said second position, thereby moving said lift off wheels from said raised position to said lowered position and consequently raising said surface cleaning nozzle to a raised position.

2. The vacuum cleaner as claimed in claim 1 wherein said lower portion of said handle comprises a cylindrical housing with a peripheral surface.

3. The vacuum cleaner as claimed in claim 2 wherein said first cam engagement means comprises an abutment surface positioned on said peripheral surface.

4. The vacuum cleaner as claimed in claim 3 wherein said cam member extends longitudinally and said first pivot axis transversely thereto and said first portion travels downwardly as said second portion travels upwardly.

5. An upright vacuum cleaner for cleaning a surface, comprising:

(a) a longitudinally extending ground engaging portion defining a longitudinal direction and having a surface cleaning nozzle, rear wheels and lift off wheels, said lift off wheels positioned forwardly of said rear wheels and moveable between a raised operating position and a lowered storage position;

(b) a handle pivotally mounted on said ground engaging portion, said handle moveable between a raised storage position and a lowered operating position, said handle having a lower portion;

(c) a first engagement member drivenly connected to said lower portion of said handle;

(d) a first transfer member having first ad second portions positioned on opposed sides of the first transfer member, said first portion being operatively engagable with said first engagement member for converting rotational movement of said handle a it is moved to said raised position to upward motion of said second portion; and, (e) a second transfer member, said second transfer member having i. an engagement portion operatively engaging said second portion of said first transfer member and ii. a coonecting portion operably connected to said lift off wheels, said first transfer member being operatively engagable with said second transfer member with said first engagement member for converting rotational movement of said handle as it is moved to said raised position to upward motion of said second portion of said first transfer member, said second transfer member converting upward motion of said second portion of said first transfer member to downward motion of said lift off wheels.

6. The vacuum cleaner as claimed in claim 5 wherein said second transfer member is pivotally mounted about a first pivot axis on said ground engaging portion at a position intermediate said engagement and connecting portions.

7. The vacuum cleaner as claimed in claim 6 wherein said engagement and connecting portions extend in said longitudinal direction whereby pivotal movement of said second transfer member causes said engagement portion to move in one direction and said connecting portion to move in the opposite direction.

8. The vacuum cleaner as claimed in claim 7 wherein said connecting portion includes an axle and said lift off wheels are rotatably mounted on said axle.

9. The vacuum cleaner as claimed in claim 8 wherein said first pivot axis comprises a transversely extending member, said first portion extends rearwardly from said transversely extending member and said second portion extends forwardly from said transversely extending member.

10. The vacuum cleaner as claimed in claim 9 wherein said engagement and connecting portions and said transverse member are of unitary construction.

11. The vacuum cleaner as claimed in claim 9 wherein said engagement and connecting portion define an obtuse angle.

12. The vacuum cleaner as claimed in claim 7 wherein said first transfer member comprises a calm member which is pivotally mounted on said ground engaging portion about a second pivot axis, said first and second portions are positioned on opposite sides of said second pivot axis, and said second transfer member is mounted on said ground engaging portion forward of said second pivot axis.

13. The vacuum cleaner as claimed in claim 5 wherein said first transfer member comprises a cam member.

14. The vacuum cleaner as claimed in claim 13 wherein said cam member extends in said longitudinal direction and said pivot axis extends transversely thereto and said second transfer member is mounted on said ground engaging portion forward of said pivot axis of said first transfer member.

15. The vacuum cleaner as claimed in claim 13 wherein said second portion comprises a cam surface and said engagement portion of said second transfer member cams along said cam surface as said handle travels between said raised and lowered positions.

16. The vacuum cleaner as claimed in claim 15 wherein said lower portion of said handle comprises a cylindrical housing with a peripheral surface, said second portion of said cam member comprises a second cam surface and said second cam surface cams along said peripheral surface as said handle travels between said raised and lowered positions.

17. The vacuum cleaner as claimed in claim 16 wherein said first engagement member comprises an abutment surface positioned on said peripheral surface for engaging said first engagement surface.

18. The vacuum cleaner as claimed in claim 17 wherein said abutment surface comprises a recessed surface in said peripheral surface.

19. The vacuum cleaner as claimed in claim 5 further comprising an abutment member for limiting the travel of said lift off wheels towards said ground engaging portion.

20. The vacuum cleaner as claimed in claim 19 wherein said lift off wheels are rotatably mounted on an axle, said ground engaging portion further comprises a first detent member which is vertically fixed in position with respect to said ground engaging member, said abutment member comprises a vertically extending member having a lower end for abutting said axle and an upper end having a second detent member for engaging said first detent member to prevent upward movement of said abutment member.

21. The vacuum cleaner as claimed in claim 20 wherein said abutment member is vertically movably within a channel, said first detent member comprises a plurality of detents, each of said detents, when engaged with said upper end, being positioned a differing amount above said surface cleaning nozzle and adjustment member for alternately engaging different detents with said second detent member.

22. The vacuum cleaner as claimed in claim 21 wherein said vacuum cleaner has a casing having an upper surface at an angle to the horizontal and said adjustment member for adjusting the detent which is engaged by said upper end comprises a slide member positioned in said upper surface.

23. An upright vacuum cleaner for cleaning a surface comprising:

(a) a longitudinally extending ground engaging portion defining a longitudinal direction and having a surface cleaning nozzle, a vertically extending member, rear wheels and lift off wheels, said lift off wheels positioned forwardly of said rear wheels and moveable between a raised operating position and a lowered storage position, said lift off wheels being rotatably mounted on an axle;

(b) a plurality of first detent members mounted on said ground engaging member;

(c) said vertically extending member has a lower end for abutting said axle and an upper end having a second detent member for alternately engaging each of said first detent members to prevent upward movement of said vertically extending, said vertically extending member being vertically moveable within a channel, each of said first detent members, when engaged with said upper end, being positioned a differing amount above said surface cleaning nozzle; and, (d) adjustment member for alternately engaging different first detent members with said second detent member.

24. The vacuum cleaner as claimed in claim 23 wherein said vacuum cleaner has a casing having an upper surface at an angle to the horizontal and said adjustment member for adjusting the first detent member which is engaged by said second detent member comprises a slide member positioned in said upper surface.

* * * * *